US006192818B1

(12) United States Patent
Rogers-Smith

(10) Patent No.: US 6,192,818 B1
(45) Date of Patent: Feb. 27, 2001

(54) PROTECTIVE DEVICE FOR WATERCRAFT

(76) Inventor: Sue Rogers-Smith, 404 E. Fulton St., Farmington, IL (US) 61531

( * ) Notice: Subject to any disclaimer, the term of this patent is extended or adjusted under 35 U.S.C. 154(b) by 0 days.

(21) Appl. No.: 09/412,048

(22) Filed: Oct. 4, 1999

Related U.S. Application Data

(60) Provisional application No. 60/149,415, filed on Aug. 18, 1999.

(51) Int. Cl.[7] ..... B63B 59/02
(52) U.S. Cl. ..... 114/219; 114/343
(58) Field of Search ..... 114/364, 361, 114/343, 219

(56) References Cited

U.S. PATENT DOCUMENTS

| | | | |
|---|---|---|---|
| 2,337,787 | 12/1943 | Waller, Jr. | 114/219 |
| 2,536,651 | 1/1951 | Johnson | 114/219 |
| 2,940,414 | 6/1960 | Moore | 114/219 |
| 3,055,022 | 9/1962 | Vallquist | 9/1 |
| 3,220,026 | 11/1965 | Lichti | 9/1 |
| 4,751,891 | 6/1988 | Wilson | 114/219 |
| 4,762,080 | 8/1988 | Pearson | 114/219 |
| 4,909,172 | 3/1990 | Hamby | 114/219 |
| 4,962,719 | 10/1990 | Hughes et al. | 114/343 |
| 5,133,516 | 7/1992 | Marentic et al. | 244/130 |
| 5,254,395 * | 10/1993 | Hodnett, III | 428/217 |
| 5,485,801 | 1/1996 | Gibbs | 114/219 |
| 5,648,149 * | 7/1997 | Rukavina et al. | 428/215 |
| 5,688,356 | 11/1997 | Sagi | 156/331.7 |

* cited by examiner

*Primary Examiner*—Stephen Avila
(74) *Attorney, Agent, or Firm*—Mark E. Wiemelt

(57) ABSTRACT

A protective device (10) for protecting the bow (12) of a watercraft (14) from damage caused by collisions of the watercraft with trailers, docks, the shore, other watercraft, debris in the water, and the like, which does not significantly alter the resulting hydrodynamic flow of water over the bow (12) of a watercraft (14). The protective device (10) comprising a generally planar aliphatic transparent deformable urethane member (56) and an adhesive (22) securing the urethane member (56) to the exterior surface of the bow (12) of a watercraft (14).

5 Claims, 4 Drawing Sheets

PROTECTIVE DEVICE FOR WATERCRAFT

PRIORITY

This is a nonprovisional application of provisional patent application Ser. No. 60/149415, filed Aug. 18, 1999

BACKGROUND OF THE INVENTION

1. Field of the Invention

The present invention relates generally to a new and improved protective device for watercraft. More particularly, the invention is directed to a protective device which comprises a generally planar aliphatic transparent deformable urethane member which is approximately 16 millimeters thick and which is attachable to a watercraft bow by 3M™ VHB™ adhesive to protect the bow from damage caused by collisions of the watercraft with trailers, docks, the shore, other watercraft, debris in the water, and the like.

2. Description of the Related Art

Numerous devices have heretofore been proposed for providing bow protection to various types of watercraft. However, each of the prior art devices have been found wanting in one or more particulars. In particular, these devices have generally been ablative and relatively thick. Consequently, these devices have worn quickly and have also significantly altered the bow profile and the resultant hydrodynamic performance of the watercraft.

Hence, there is a need in the art for a protective device for watercraft which protects the bow of a watercraft and resists wear, mutilation and disfigurement. There is also a need in the art for a protective device which is relatively thin.

It is a primary object of the present invention to provide an improved protective device for watercraft.

More specifically, it is an object of the present invention to provide an improved protective device for watercraft which protects the bow of a watercraft from damage caused by collisions with trailers, docks, the shore, other watercraft, debris in the water, and the like.

A further object of the present invention is to provide an improved protective device for watercraft which resists wear, mutilation and disfigurement.

Another object of the instant invention is to provide an improved protective device for watercraft which is relatively thin.

A further object of the present invention to provide an improved protective device for watercraft which is relatively thin so that bow profile of the watercraft and the hydrodynamic performance of the watercraft are not significantly altered.

Another object of the present invention is to provide an improved protective device for watercraft which is deformable when disposed over the bow of a watercraft in order to conform to the bow of various shapes and sizes of watercraft.

It is therefore an object of the present invention to provide an improved protective device for watercraft which have all the advantages of the prior art and none of its disadvantages.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

SUMMARY OF INVENTION

A broad aspect of the invention comprises a novel protective device for a watercraft which protects the exterior surface of the bow of a watercraft of different shapes and sizes from damage which is caused by collisions of the watercraft with trailers, docks, the shore, other watercraft, debris in the water, and the like which does not significantly alter the bow profile and the resulting hydrodynamic flow of water over the exterior surface of the bow of a watercraft.

One embodiment of the invention utilizes a generally planar aliphatic transparent deformable urethane member. The urethane member has a pair of opposed elongated arm members which diverge outwardly from the length of the longitudinal axis of the urethane member. The urethane member is shaped and dimensioned to conform to and cover the exterior surface of the bow of a watercraft. A layer of adhesive secures the urethane member to the exterior surface of the bow of a watercraft.

For this embodiment, it is most advantageous that the urethane member has an approximate uniform thickness of 16 millimeters. It is also beneficial for the layer of adhesive to uniformly cover the entire surface of the urethane member in order to attach the urethane member to the exterior surface of the bow of a watercraft. Further embodiments will become obvious hereafter.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
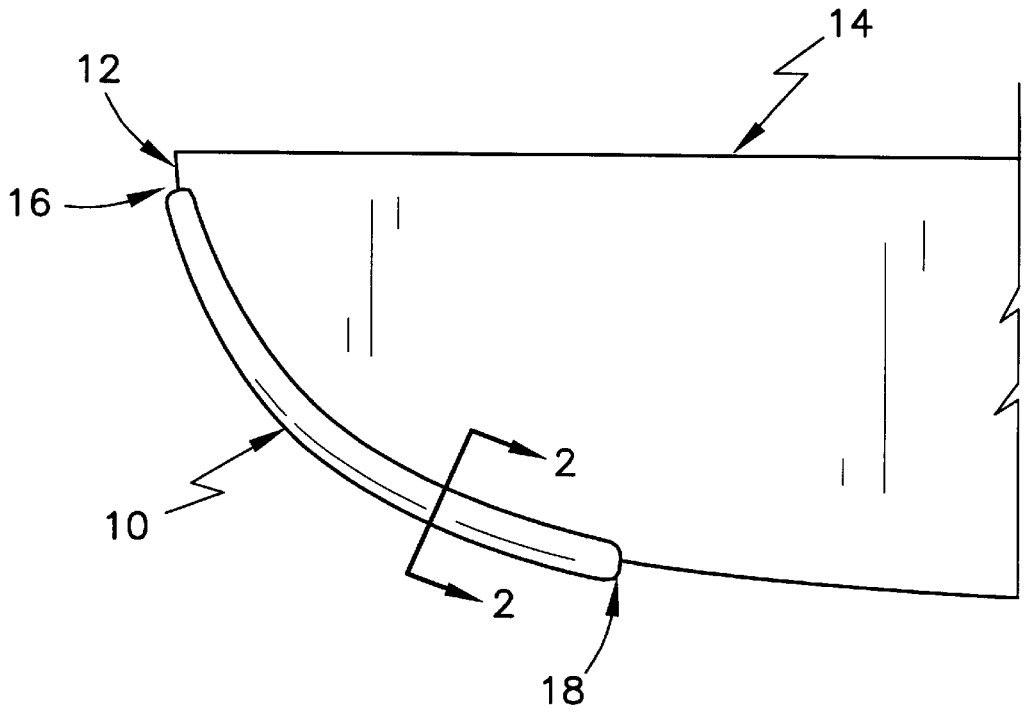
FIG. 1 is a fractional side view illustrating a watercraft equipped with the preferred embodiment of the protective device which protects the bow of a watercraft.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Referring to the drawings, FIG. 1 illustrates a fractional side view of a watercraft 14 which is equipped with the protective device 10. The protective device 10 covers the bow 12 (front, nose) area of the watercraft 14 and protects the bow 12 from collisions of the watercraft 14 with trailers, docks, the shore, other watercraft, debris in the water, and the like.

Figure 2:
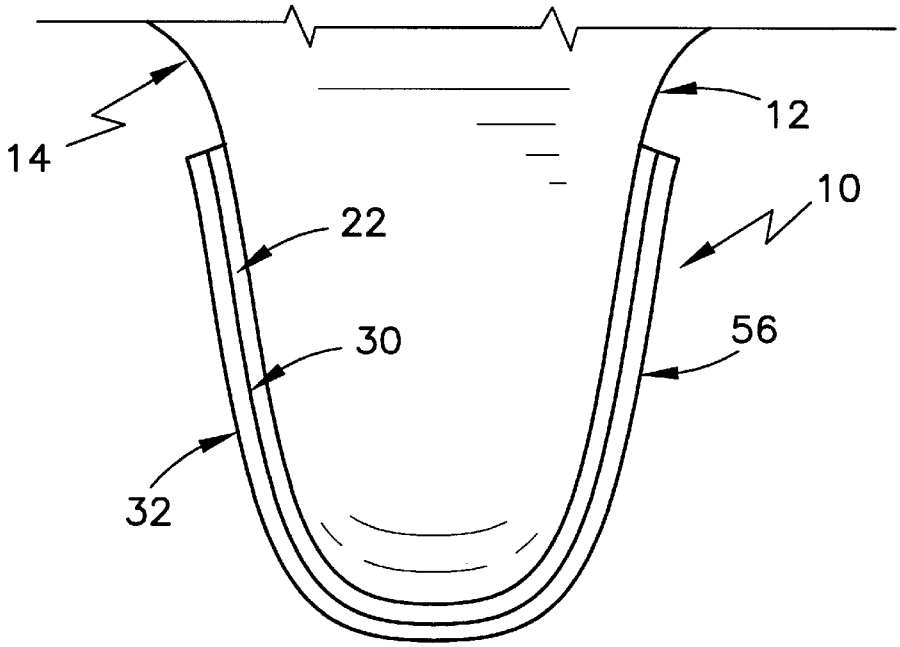
FIG. 2 is an illustration of a cross-section of a watercraft equipped with the protective device taken across lines 2—2 of FIG. 1.

Now referring to FIG. 2, the urethane member 56 of the protective device 10 is attached to the bow 12 of the watercraft 14 by an adhesive surface 22. The protective device 10 includes a urethane member 56 and an adhesive surface 22. The urethane member 56 is formed of a generally planar aliphatic transparent deformable urethane material.

In this particular preferred embodiment, the adhesive surface 22 used to attach the urethane member 56 of the protective device 10 over the bow 12 of the watercraft 14 is 3M™VHB™, commercially available from the Minnesota Mining and Manufacturing Company (3M) of St. Paul, Minn. It will be readily appreciated by those skilled in the art that other suitable materials are possible as an adhesive which are consistent with the spirit and scope of the present invention.

In the presently preferred embodiment of the present invention for protecting a portion of the exterior surface of the bow 12 of a watercraft 14, the urethane member 56 of the protective device 10 has a uniform cross-sectional thickness. It is most preferred that the urethane member 56 of the protective device 10 has a uniform cross-sectional thickness of 16 millimeters. It will be readily appreciated by those skilled in the art that other suitable thicknesses which are relatively thin compared to the prior art are possible which are consistent with the spirit and scope of the present invention. For example, the urethane member 56 may have a cross-sectional thickness of less than 50 millimeters.

Figure 3:
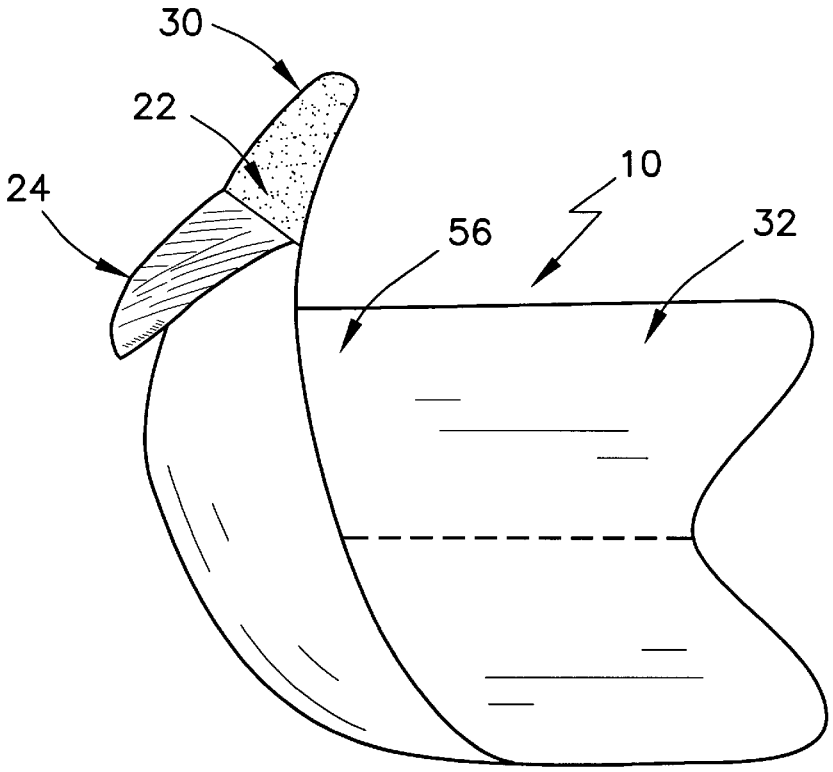
FIG. 3 is an elevated perspective view of the protective device for a watercraft.

FIG. 3 illustrates an elevated perspective view of the protective device 10. The urethane member 56 of the protective device 10 is secured to a portion of the exterior surface of the bow 12 of a watercraft 14 by an adhesive surface 22. In the preferred embodiment, the adhesive surface 22 substantially covers the surface of the bow side of the protective device 30.

In the presently preferred embodiment of the present invention, an adhesive backing 24 is disposed over the adhesive surface 22, the adhesive backing 24 being removably fastened to the adhesive surface 22. The adhesive backing 24 is removably fastened to the adhesive surface 22 in order to retain the adhesive characteristic of the adhesive surface 22 until the protective device 10 is to be installed over the bow 12 of a watercraft 14. When the protective device 10 is to installed on the bow 12 of a watercraft 14, the adhesive backing 24 is peeled away from the adhesive surface 22 in order to expose the adhesive surface 22. Once the adhesive backing 24 is entirely removed and the adhesive surface 22 is entirely exposed, the protective device 10 can be applied to the bow 12 of the watercraft 14. In the preferred embodiment, the adhesive surface 22 would substantially cover the bow side of the protective device 30, leaving no gaps for air or other materials between the urethane member 56 of the protective device 10 and the bow 12 of the watercraft 14.

Figure 4:
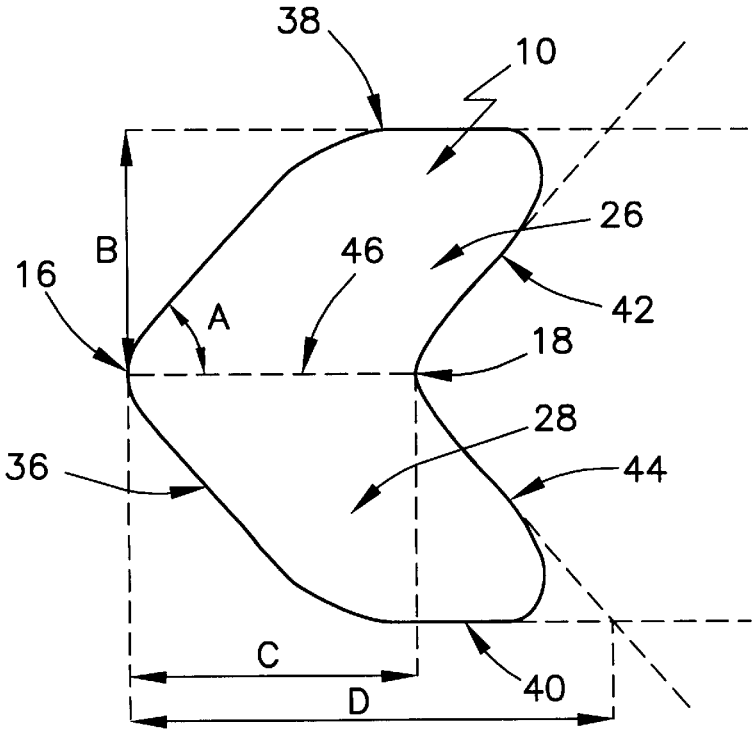
FIG. 4 is a top view of a preferred embodiment of the protective device for a watercraft.
Figure 5:
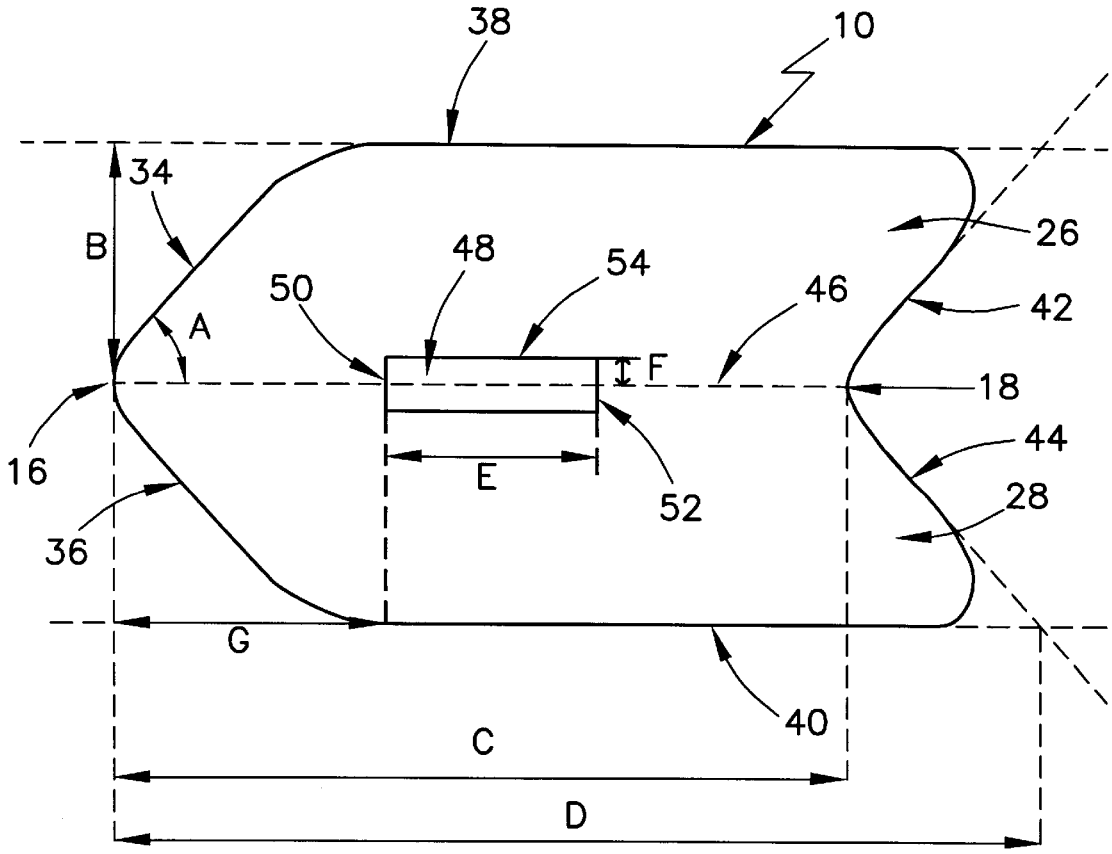
FIG. 5 is a top view of an alternate embodiment of the protective device for a watercraft.

Referring to FIGS. 4 and 5, the protective device 10 has a pair of opposed wings 26, 28 diverging outwardly from the length of the longitudinal axis of the protective device 46. The protective device 10 is shaped and dimensioned to conform to and cover the exterior surface of the bow 12 of a watercraft 14, wherein the protective device 10 is uniform in thickness. Most preferably, before the protective device 10 is applied to the boat, the protective device 10 is planar and V-shaped.

The fore-edges 34, 36 of the opposed wings 26, 28 project from the longitudinal axis of the protective device 46 at an angle indicated by arrows A. Typically, before being applied to a watercraft 14, the protective device 10 would have the dimensions such that B is the length of the protective device 10 as measured from the longitudinal axis of the protective device 46 to each of the side edges of the opposed wings 38, 40. C is the length of the protective device 10 as measured along the longitudinal axis of the protective device 46 from the fore-end of the protective device 16 to the aft-end of the protective device 18. D is the length of the protective device 10 as measured from the fore-end of the protective device 16 to an imaginary point located at the intersection of imaginary lines extending from the side edges of the opposed wings 38, 40 and imaginary lines extending from the aft-edges of the opposed wings 42, 44.

FIG. 4 is a top view of a preferred embodiment of the protective device 10. In this embodiment, before being applied to the bow 12 of a watercraft 14, the protective device 10 would be generally planar and V-shaped. In the preferred embodiment, the angle A is approximately 50 degrees. In this preferred embodiment, before being applied to a watercraft 14, it is presently preferable the protective device 10 would have dimensions such that the dimension B would be 5¼, inches, the dimension C would be 6 inches, and the dimension D would be 10¹⁄₁₆ inches.

FIGS. 5 illustrates an alternate embodiment of the protective device 10. In this preferred embodiment, a bow eyehook cutout 48 in the protective device 10 proximate to the fore-end of the protective device 16 forms an aperture for introducing therethrough an eyehook 20 attached on the exterior of the bow 12 of a watercraft 14. E is the length of the bow eyehook cutout 48 as measured along the longitudinal axis of the protective device 46 from the fore-edge of the bow eyehook cutout 50 to the aft-edge of the bow eyehook cutout 52. F is the width of the bow eyehook cutout 48 as measured from the longitudinal axis of the protective device 46 to the side edge of the bow eyehook cutout 48. G is the length as measured the fore-end of the protective device 16 to the fore-end of the bow eyehook cutout 50.

In one alternate embodiment of the protective device 10, before being applied to the bow 12 of a watercraft 14, the protective device 10 would be generally planar and V-shaped. In the preferred embodiment, the angle A is approximately 50 degrees. In this preferred embodiment, before being applied to a watercraft 14, it is presently preferable that the protective device 10 would have dimensions such that the dimension B would be 5¼ inches, the dimension C would be 15½ inches, and the dimension D would be 19⅝ inches. It is also preferred that the length E is 4 inches and length F is ½ inch, and the length G 5¾ inches.

In another alternate embodiment of the protective device 10, before being applied to the bow 12 of a watercraft 14, the protective device 10 would be generally planar and V-shaped. In the preferred embodiment, the angle A is approximately 50 degrees. In this preferred embodiment, before being applied to a watercraft 14, it is presently preferable that the protective device would have dimensions such that the dimension B would be 5¼ inches, the dimension C would be 9 inches, and the dimension D would be 13¹⁄₁₆ inches. It is also preferred that the length E is 4 inches and length F is ½ inch, and the length G is 2¹¹⁄₁₆ inches.

Figure 6:
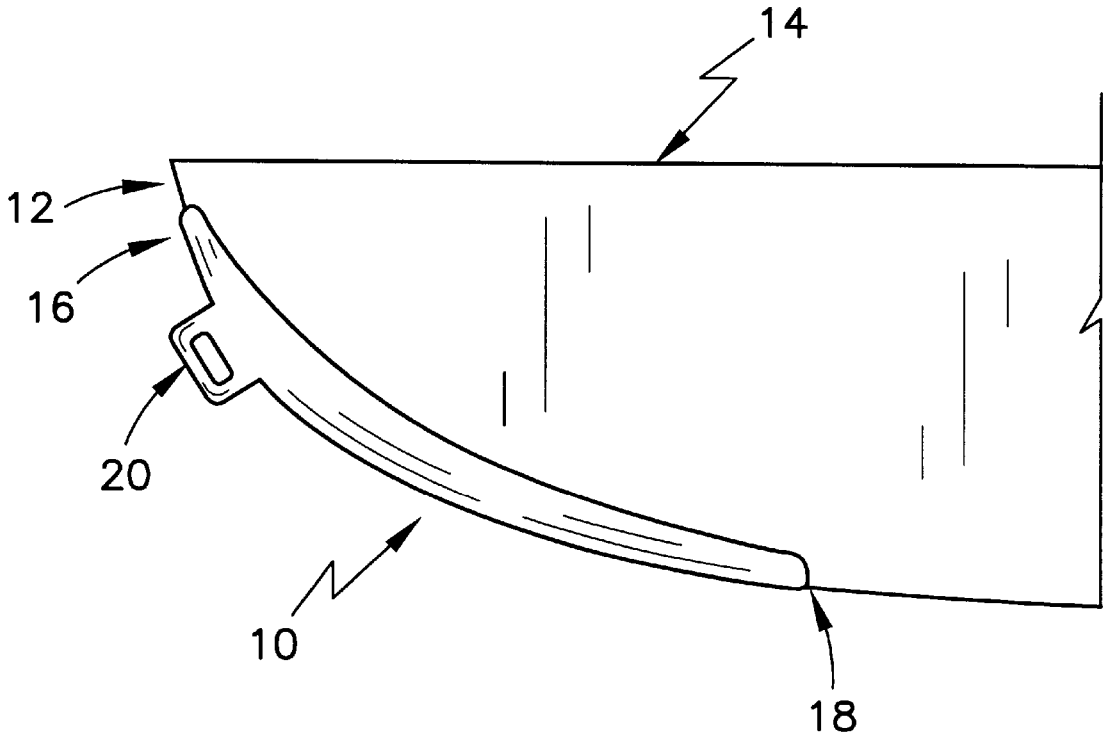
FIG. 6 is a fractional side view illustrating a watercraft equipped with the alternate embodiment of the protective device which protects the bow of a watercraft.

FIG. 6 illustrates a fractional side view of a watercraft 14 which is equipped with the alternate embodiment of the protective device 10 which is depicted in FIG. 5. The protective device 10 includes a bow eyehook cutout 48 proximate to the fore-end of the protective device 16, which forms an aperture for introducing therethrough an eyehook 20 which is attached on the exterior of the bow 12 of a watercraft 14.

It will be readily appreciated by those skilled in the art, however, that other thickness, dimensions, shapes, or configurations of the urethane member are possible, provided that the urethane member 56 has a generally uniform cross-sectional thickness.

While the invention has been described in connection with a preferred embodiment and several alternative embodiments, it will be understood that it is not intended that the invention be limited to those embodiments. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing discussion is illustrative of the invention. However, since many embodiments of the invention can be made without departing from the spirit and scope of the invention, the invention resides wholly in the claims hereinafter appended.

I claim:

1. A protective device for watercraft for protecting at least a portion of the exterior surface of the bow of a watercraft of different shapes and sizes from damage caused by collisions of the watercraft with trailers, docks, the shore, other watercraft, debris in the water, and the like, the watercraft having an eyehook for securement purposes, the protective device comprising:

a. a generally planar aliphatic urethane member having a pair of opposed elongated arm members diverging outwardly from the length of the longitudinal axis of the urethane member, the urethane member being deformable and transparent and further being shaped and dimensioned to conform with and cover the exterior surface of the bow of the watercraft, the urethane member further having a cutout proximate to a fore-end thereof adapted for insertion of the eyehook of said watercraft, whereby the protective device does not significantly alter the bow profile and the resulting hydrodynamic flow of water over the exterior surface of the bow of a watercraft, and b. a layer of adhesive securing the urethane member to the exterior surface of the bow of the watercraft.

2. The protective device as recited in claim 1 wherein the urethane member comprises a urethane member having generally uniform thickness.

3. The protective device as recited in claim 2 wherein the urethane member comprises a urethane member having less than 50 millimeters in thickness.

4. The protective device as recited in claim 3 wherein the urethane member comprises a urethane member having approximately 16 millimeters in thickness.

5. The protective device as recited in claim 1 wherein the layer of adhesive comprises a layer of adhesive that uniformly covers the entire surface of the urethane member, wherein the layer of adhesive securely attaches the protective device to the exterior surface of the bow of a watercraft.

* * * * *